US008035314B2

(12) United States Patent
Zhao

(10) Patent No.: US 8,035,314 B2
(45) Date of Patent: Oct. 11, 2011

(54) METHOD AND DEVICE FOR LED CHANNEL MANAGMENT IN LED DRIVER

(75) Inventor: Bin Zhao, Irvine, CA (US)

(73) Assignee: Freescale Semiconductor, Inc., Austin, TX (US)

( * ) Notice: Subject to any disclaimer, the term of this patent is extended or adjusted under 35 U.S.C. 154(b) by 375 days.

(21) Appl. No.: 12/363,294

(22) Filed: Jan. 30, 2009

(65) Prior Publication Data

US 2009/0315481 A1 Dec. 24, 2009

Related U.S. Application Data

(60) Provisional application No. 61/074,944, filed on Jun. 23, 2008.

(51) Int. Cl.
*H05B 37/02* (2006.01)

(52) U.S. Cl. ..... 315/297; 315/307; 315/308

(58) Field of Classification Search ..... 315/297, 315/307, 224, 308

See application file for complete search history.

(56) References Cited

U.S. PATENT DOCUMENTS

| | | | |
|---|---|---|---|
| 3,973,197 | A | 8/1976 | Meyer |
| 4,162,444 | A | 7/1979 | Rodgers |
| 4,615,029 | A | 9/1986 | Hu et al. |
| 4,649,432 | A | 3/1987 | Watanabe et al. |
| 4,686,640 | A | 8/1987 | Simison |
| 5,025,176 | A | 6/1991 | Takeno |
| 5,038,055 | A | 8/1991 | Kinoshita |
| 5,455,868 | A | 10/1995 | Sergent et al. |
| 5,508,909 | A | 4/1996 | Maxwell et al. |
| 5,635,864 | A | 6/1997 | Jones |
| 5,723,950 | A | 3/1998 | Wei et al. |
| 6,002,356 | A | 12/1999 | Cooper |
| 6,281,822 | B1 | 8/2001 | Park |
| 6,373,423 | B1 | 4/2002 | Knudsen |
| 6,636,104 | B2 | 10/2003 | Henry |
| 6,822,403 | B2 * | 11/2004 | Horiuchi et al. ..... 315/307 |
| 6,864,641 | B2 | 3/2005 | Dygert |

(Continued)

FOREIGN PATENT DOCUMENTS

JP 2003332624 A 11/2003

(Continued)

OTHER PUBLICATIONS

PCT Application No. PCT/US2010/028289; Search Report and Written Opinion dated Dec. 15, 2010.

(Continued)

*Primary Examiner* — Daniel D Chang

(57) ABSTRACT

Disclosed are example open channel detection techniques at a light emitting diode (LED) driver of an LED system. The LED driver does not enable its LED channels before normal operation so as to inhibit current flow through the LED channels during start-up. While the LED channels are disabled, the LED driver compares the voltages at the LED channel inputs with a predetermined voltage to determine whether an operational LED string of an associated LED panel is connected to the LED channel. In the event that an LED channel is determined to be an "open" channel, the LED driver further disables the LED channel for the following normal operational mode. Otherwise, if the LED channel is determined to be connected to an operational LED string, the LED driver enables the LED channel for the normal operational mode, during which the LED channel can be selectively activated for light output subject to display data for the LED panel.

20 Claims, 3 Drawing Sheets

U.S. PATENT DOCUMENTS

| | | | | |
|---|---|---|---|---|
| 6,943,500 | B2 | 9/2005 | LeChevalier | |
| 7,262,724 | B2 | 8/2007 | Hughes et al. | |
| 7,307,614 | B2 | 12/2007 | Vinn | |
| 7,315,095 | B2 * | 1/2008 | Kagemoto et al. | 307/39 |
| 7,391,280 | B2 | 6/2008 | Hsu | |
| 7,436,378 | B2 | 10/2008 | Ito et al. | |
| 7,459,959 | B2 | 12/2008 | Rader et al. | |
| 7,511,545 | B1 | 3/2009 | Kesler | |
| 7,696,915 | B2 | 4/2010 | Chmelar et al. | |
| 7,777,704 | B2 | 8/2010 | S et al. | |
| 7,973,495 | B2 | 7/2011 | Ion et al. | |
| 2004/0208011 | A1 | 10/2004 | Horiuchi et al. | |
| 2004/0233144 | A1 | 11/2004 | Rader et al. | |
| 2006/0164162 | A1 | 7/2006 | Dauphinee et al. | |
| 2006/0186830 | A1 | 8/2006 | Shami et al. | |
| 2006/0261895 | A1 | 11/2006 | Kocaman et al. | |
| 2007/0080911 | A1 | 4/2007 | Liu et al. | |
| 2007/0253330 | A1 | 11/2007 | Tochio et al. | |
| 2008/0054815 | A1 | 3/2008 | Kotikalapoodi | |
| 2008/0297067 | A1 | 12/2008 | Wang et al. | |
| 2009/0108775 | A1 | 4/2009 | Sandner et al. | |
| 2009/0128045 | A1 | 5/2009 | Szczeszynski et al. | |
| 2009/0187925 | A1 | 7/2009 | Hu et al. | |
| 2009/0230874 | A1 | 9/2009 | Zhao et al. | |
| 2009/0230891 | A1 | 9/2009 | Zhao et al. | |
| 2009/0273288 | A1 | 11/2009 | Zhao et al. | |
| 2010/0013395 | A1 | 1/2010 | Archibald et al. | |
| 2010/0013412 | A1 | 1/2010 | Archibald et al. | |
| 2010/0026203 | A1 | 2/2010 | Zhao et al. | |
| 2010/0085295 | A1 | 4/2010 | Zhao et al. | |

FOREIGN PATENT DOCUMENTS

| | | | |
|---|---|---|---|
| JP | 2005116199 | A | 4/2005 |
| KR | 1020070082004 | A | 8/2007 |
| WO | 2005022596 | A2 | 3/2005 |

OTHER PUBLICATIONS

Mc Nerney, Tim, "constant-current power supply for Luxeon 5W LED with low-voltage warning and shut-off Software Documentation, as shipped to Mali in first 45 prototypes," Nov. 2004, www.designthatmatters.org/ke/pubs/kled-doc.txt, 5 pages.

Maxim: "Application Note 810, Understanding Flash ADCs," Oct. 2, 2001, 8 pages.

National Semiconductor Data Sheet: "LM3432/LM3432B 6-Channel Current Regulator for LED Backlight Application," May 22, 2008, pp. 1-18.

U.S. Appl. No. 12/537,443, filed Aug. 7, 2009, entitled Pulse Width Modulation Frequency Conversion.

U.S. Appl. No. 12/703,239, filed Feb. 10, 2010, entitled "Pulse Width Modulation With Effective High Duty Resolution".

U.S. Appl. No. 12/537,692, filed Aug. 7, 2009, entitled "Phase-Shifted Pulse Width Modulation Signal Generation".

U.S. Appl. No. 12/625,818, filed Nov. 25, 2009, entitled "Synchronized Phase-Shifted Pulse Width Modulation Signal Generation".

U.S. Appl. No. 12/703,249, filed Feb. 10, 2010, entitled "Duty Transition Control in Pulse Width Modulation Signaling".

Luke Huiyong Chung, Electronic Products: "Driver ICs for LED BLUs," May 1, 2008, 3 pages.

Akira Takahashi, Electronic Products: "Methods and features of LED drivers," Mar. 2008, 3 pages.

U.S. Appl. No. 12/340,985, filed Dec. 22, 2008, entitled "LED Driver With Feedback Calibration".

U.S. Appl. No. 12/326,963, filed Dec. 3, 2008, entitled "LED Driver With Precharge and Track/Hold".

U.S. Appl. No. 12/367,672, filed Feb. 9, 2009, entitled "Configuration for Dynamic Power Control in LED Displays".

U.S. Appl. No. 12/424,326, filed Apr. 15, 2009, entitled "Peak Detection With Digital Conversion".

U.S. Appl. No. 12/504,841, filed Jul. 17, 2009, entitled "Analog-To-Digital Converter With Non-Uniform Accuracy".

U.S. Appl. No. 12/690,972, filed Jan. 21, 2010, entitled "Serial Cascade of Minimum Tail Voltages of Subsets of LED Strings for Dynamic Power Contrl in LED Displays".

U.S. Appl. No. 12/363,607, filed Jan. 30, 2009, entitled "LED Driver With Dynamic Headroom Control".

International Application No. PCT/US2009/035284, Search Report and Written Opinion, Oct. 28, 2009, 11 pages.

Texas Instruments Publication, "Interleaved Dual PWM Controller with Programmable Max Duty Cycle," SLUS544A, (UCC28220, UCC28221) Sep. 2003, pp. 1-28.

Office Action—NFOA Feb. 4, 2010, 11 pages.

Office Action—NOA Jun. 2, 2010, 7 pages.

Office Action—NOA Jul. 9, 2010, 12 pages.

International App. No. PCT/US2009/065913, Search Report mailed Jul. 7, 2010, 4 pages.

Notice of Allowance mailed Apr. 7, 2011 for U.S. Appl. No. 12/326,963, 20 pages.

Notice of Allowance mailed Jun. 21, 2011 for U.S. Appl. No. 12/340,985, 27 pages.

Non-Final Office Action mailed May 4, 2011 for U.S. Appl. No. 12/367,672, 26 pages.

Non-Final Office Action mailed Apr. 19, 2011 for U.S. Appl. No. 12/363,607, 17 pages.

Notice of Allowance mailed Jul. 19, 2011 for U.S. Appl. No. 12/424,326, 27 pages.

Ex parte Quayle mailed Jul. 20, 2011 for U.S. Appl. No. 12/363,179, 25 pages.

Notice of Allowance mailed Aug. 11, 2011 for U.S. Appl. No. 12/363,607, 9 pages.

* cited by examiner

METHOD AND DEVICE FOR LED CHANNEL MANAGMENT IN LED DRIVER

CROSS-REFERENCE TO RELATED APPLICATIONS

The present disclosure claims priority to U.S. Patent Application No. 61/074,944, filed Jun. 23, 2008 and entitled "METHOD AND DEVICE FOR LED CHANNEL MANAGEMENT IN LED DRIVER", the entirety of which is incorporated by reference herein.

FIELD OF THE DISCLOSURE

The present disclosure relates generally to displays utilizing light emitting diodes (LEDs) and more particularly to LED drivers for LED-based displays.

BACKGROUND

Light emitting diodes (LEDs) often are used for backlighting sources in liquid crystal displays (LCDs) and other types of displays. In backlighting implementations, the LEDs are arranged in parallel "strings" driven by a shared voltage source, each LED string having a plurality of LEDs connected in series. To provide consistent light output between the LED strings, each LED string typically is driven at a regulated current that is substantially equal among all of the LED strings. The number of LED strings implemented in LED panels can vary between panel types, sizes, and applications. One method for accommodating different uses of different numbers of LED strings is to design and manufacture separate LED drivers for each LED string configuration. This approach results in multiple parts and complicates inventory management. Another conventional approach is to configure the LED driver to use a conventional open channel detection process whereby the output of the voltage source is ramped up to an over-voltage protection level while all of the LED channels are enabled and then attempting to detect missing LED strings based on the operation of the enabled LED channels at the LED driver. This approach, while permitting one LED driver to be implemented for different numbers of LED strings, results in excessive power consumption during the open channel detection process and can lead to thermal shutdown of the LED driver.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

Disclosed herein are example techniques for open channel detection at a light emitting diode (LED) driver of an LED system. In at least one embodiment, the LED driver does not enable its LED channels before normal operation so as to inhibit current flow through the LED channels during start-up. While the LED channels are disabled, the LED driver compares the voltages at the LED channel inputs with a predetermined voltage to determine whether an operational LED string of an associated LED panel is connected to the LED channel. In the event that an LED channel is determined to be an "open" channel (i.e., not connected to an LED string or connected to a non-operational LED string), the LED driver further disables the LED channel for the following normal operational mode. Otherwise, if the LED channel is determined to be connected to an operational LED string, the LED driver enables the LED channel for the normal operational mode, during which the LED channel can be selectively activated for light output subject to control data for the LED panel.

The term "LED string," as used herein, refers to a grouping of one or more LEDs connected in series. The "head end" of a LED string is the end or portion of the LED string which receives the driving voltage/current and the "tail end" of the LED string is the opposite end or portion of the LED string. The term "tail voltage," as used herein, refers the voltage at the tail end of a LED string or representation thereof (e.g., a voltage-divided representation, an amplified representation, etc.). The term "LED channel," as used herein, refers to the circuitry of an LED driver and other associated circuitry that controls the operation of a corresponding LED strings. Thus, to "enable" or "turn on" an LED channel means to configure the LED channel circuitry such that sufficient current is permitted to flow through to the corresponding LED string to activate the LEDs of the LED string. Conversely, to "disable" or "turn off" an LED channel means to configure the LED channel circuitry so as to inhibit or prevent the provision of sufficient current to the LED string. An LED channel that is configured to inhibit current flow is configured so as to inhibit a magnitude of current sufficient to activate the corresponding LED string, while still permitting a small amount of current flow due to leakage currents in the circuitry of the LED channel. An illustrative embodiment includes enabling or disabling a current regulator of an LED channel so as to enable or disable, respectively, a corresponding LED channel. However, other mechanisms may be used to enable and disable a LED channel without departing from the scope of the present disclosure. To illustrate, a switch could be used to connect or disconnect a supply voltage to the head end of the LED string to enable or disable the LED string, respectively.

Figure 1:
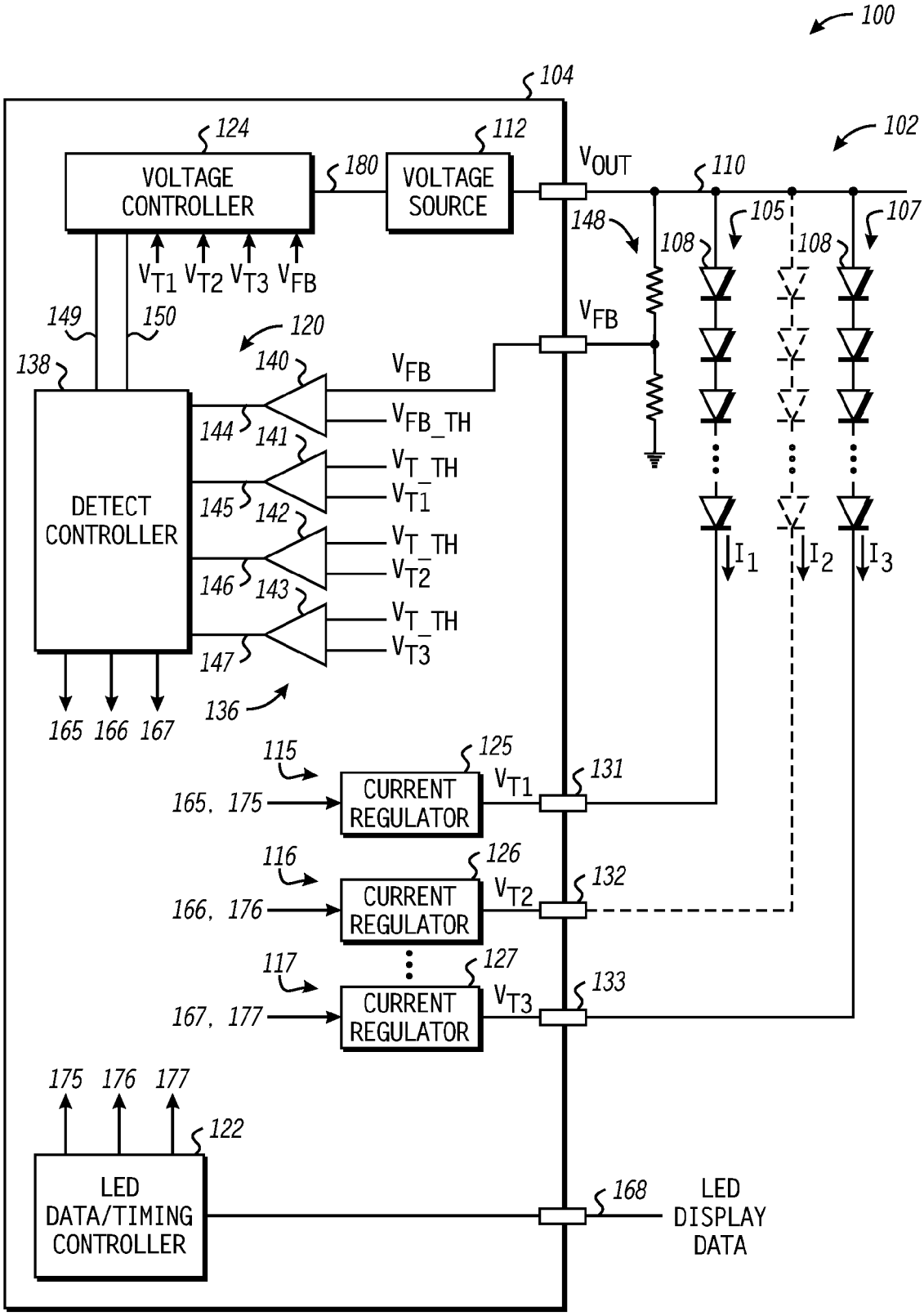
FIG. 1 is a diagram illustrating a light emitting diode (LED) system in accordance with at least one embodiment of the present disclosure.

FIG. 1 illustrates a LED system 100 in accordance with at least one embodiment of the present disclosure. The LED system 100 can include, for example, a LED-based television or LED-based computer monitor. The LED system 100 alternately can include the display system for any of a variety of portable display devices, such as cell-phones, personal digital assistants (PDAs), notebook computers, etc.

In the depicted example, the LED system 100 includes a LED panel 102, a LED driver 104, and a voltage source 112 for providing an output voltage $V_{OUT}$ to drive the LED panel 102. In one embodiment described herein the LED driver 104 is implemented as a single integrated circuit (IC) device, such as an application specific integrated circuit (ASIC). The LED panel 102 includes a plurality of LED strings (e.g., LED strings 105 and 107). Each LED string includes one or more LEDs 108 connected in series. The LEDs 108 can include, for example, white LEDs, red, green, blue (RGB) LEDs, organic LEDs (OLEDs), etc. Each LED string is driven by the output voltage $V_{OUT}$ received at the head end of the LED string via a voltage bus 110 (e.g., a conductive trace, wire, etc.) from the voltage source 112. In one embodiment, the voltage source 112 is implemented as a boost converter configured to drive an output voltage $V_{OUT}$ using an input voltage (not shown), although other types of voltage sources can be implemented instead of a boost converter. Further, although the voltage source 112 is illustrated as implemented entirely within the LED driver 104, in alternate embodiments the voltage source 112 can be wholly or partially implemented external to the LED driver 104.

The LED driver 104 includes a plurality of LED channels (e.g., LED channels 115, 116, and 117), an LED channel detector 120, an LED data/timing controller 122, and a voltage controller 124. Each of the LED channels includes a LED channel input configured to couple to a tail end of a corresponding LED string and a current regulator coupled to the LED channel input, whereby the current regulator is configured to regulate the current flowing at the corresponding LED channel input. In the example of FIG. 1, the LED channel 115 includes a current regulator 125 and a LED channel input 131, whereby the current regulator 125 is configured to maintain a current $I_1$ flowing through the LED channel input 131 near a fixed current (e.g., 30 mA) when the current regulator 125 is enabled and the LED channel input 131 is coupled to an operative LED string (e.g., LED string 105). However, when the current regulator 125 is disabled, the current regulator 125 inhibits current flow through the LED channel input 131 (i.e., $I_1$ is approximately zero amperes). To illustrate, the current regulator 125 can be configured into a disabled state whereby the current regulator 125 presents a high impedance with respect to the LED channel input 131 (e.g., by rendering non-conductive a transistor of the current regulator 125 that connects the LED channel input 131 to ground). Similarly, when the LED channel input 131 is not coupled to an operative LED string, there is no current flow through the LED channel input 131 as the voltage at the LED channel input 131 is substantially zero. The LED channel 116 includes a current regulator 126 and a LED channel input 132 and the LED channel 117 includes a current regulator 127 and a LED channel input 133, which operate in a similar manner with respect to currents $I_2$ and $I_3$ as illustrated in FIG. 1. In an implementation of the LED driver 104 as an IC device, the LED channel inputs 131, 132, and 133 can be implemented as, for example, input pins of the IC device.

The LED channel detector 120 includes comparison circuitry 136 and a detect controller 138. The comparison circuitry 136 includes comparators 140, 141, 142, and 143. The comparator 140 includes an input to receive a feedback voltage $V_{FB}$ representative of (proportional to) the output voltage $V_{OUT}$, an input to receive a predetermined threshold voltage $V_{FB_TH}$ (generated via, e.g., an on-chip voltage source or received off-chip), and an output to provide a signal 144 representative of the relationship between the feedback voltage $V_{FB}$ and the threshold voltage $V_{FB_TH}$. Although the voltage $V_{OUT}$ can be supplied directly as the feedback voltage $V_{FB}$, the typical magnitude of the voltage $V_{OUT}$ may exceed the design parameters of the circuitry of the LED driver 104. Accordingly, in at least one embodiment the feedback voltage $V_{FB}$ is proportionally scaled down from the voltage $V_{OUT}$ using, for example, a voltage divider 148. The voltage $V_{FB\ TH}$, in one embodiment, determines or represents the over-voltage protection threshold ($V_{OVP}$) for the LED driver 104. For example, the voltage $V_{FB_TH}$ can be set according to the following equation:

$$V_{FB_TH}=A*(V_{OVP}-C) \quad \text{EQ. 1}$$

where C is an offset voltage (typically 0 to 10 volts) and A is the scaling factor of the voltage divider 148 (i.e., A<=1).

The comparator 141 includes an input to receive a predetermined threshold voltage $V_{T_TH}$ (e.g., from an on-chip voltage source or received from off-chip), an input to receive the voltage $V_{T1}$ from the LED channel input 131, and an output to provide a signal 145 representative of the relationship between the voltage $V_{T1}$ and the threshold voltage $V_{T_TH}$. The comparator 142 includes an input to receive the threshold voltage $V_{T_TH}$, an input to receive the voltage $V_{T2}$ from the LED channel input 132, and an output to provide a signal 146 representative of the relationship between the voltage $V_{T2}$ and the threshold voltage $V_{T_TH}$. The comparator 143 includes an input to receive the threshold voltage $V_{T_TH}$, an input to receive the voltage $V_{T3}$ from the LED channel input 133, and an output to provide a signal 147 representative of the relationship between the voltage $V_{T3}$ and the threshold voltage $V_{T_TH}$. The threshold voltage $V_{T_TH}$, in one embodiment, represents a voltage greater than the voltage noise expected at a LED channel input when not connected to an operative LED string but less than the voltage expected at the tail end of an operative LED string being driven at the voltage $V_{OVP}$ (but having substantially no current flow other than leakage current). To illustrate, if the noise voltage for a disconnected LED channel input (or for an LED channel input connected to a non-operative LED string) is expected to be a maximum of 50 millivolts (mV) and the tail voltage of a LED string being driven by the voltage $V_{OUT}$ while the current regulator is disabled is expected to be at least 0.5 V, then the threshold voltage $V_{T_TH}$ would be set somewhere between 50 mV and 0.5 V (e.g., 100 or 200 mV) so as to permit the connection state of an LED channel to be discerned.

Rather than implement three separate comparators 141, 142, and 143 to compare the LED channel input voltages with the threshold voltage $V_{T_TH}$ in parallel, in an alternate embodiment, the comparison circuitry 136 instead can use a single comparator and a switch component to sequentially check each LED channel input voltage.

The detect controller 138 includes inputs to receive the signals 144-147, outputs to provide a voltage control signal 149 and LED channel status information 150 to the voltage controller 124, and outputs to provide configuration signals 165, 166, and 167 to the current regulators 125, 126, and 127, respectively. During a start-up mode of the LED driver 104, the detect controller 138 disables the LED channels 115-117 by using the configuration signals 165-167 to configure the current regulators 125-127 into disabled states whereby the current regulators 125-127 inhibit current flow through the LED channel inputs 131-133. While the current regulators 125-127 are in this disabled state, the detect controller 138 uses the state of the signal 144 to direct the voltage controller 124 (via voltage control signal 149) to control the voltage source 112 to increase the magnitude of the voltage $V_{OUT}$ until it is at a voltage $V_{OUT_TH}$ that is equal to or less than the over-voltage protection threshold $V_{OVP}$ (e.g., until $V_{FB}=V_{FB_TH}$). Once the voltage $V_{OUT}$ is at $V_{OUT_TH}$ and while the LED channels remain off, the detect controller 138 uses the states of the signals 145-147 to determine whether the LED channels 115-117, respectively, are connected to an operative LED string. To illustrate, in the event that the tail end of an operational LED string is connected to the LED channel input 131, the voltage $V_{T1}$ should be non-zero and greater than the voltage $V_{T_TH}$. Conversely, in the event that the LED channel input 131 is not connected to the tail end of an operational LED string, the voltage $V_{T1}$ should be approximately zero volts. This relationship is reflected by the signal 145 output by the comparator 141. The other LED channels 116 and 117 can be checked in the same manner.

The detect controller 138 uses these determined connection states to enable or disable LED channels for the normal operational mode of the LED driver 104 that follows the start-up mode. The detect controller 138 uses the control signals 165-167 to disable those current regulators associated with LED channels identified as not connected to operational LED strings and to enable those current regulators associated with LED channels identified as connected to operational LED strings during the operational mode. The detect controller 138 further provides an indication of which LED channels are turned on and which are turned off to the voltage controller 124 via the LED channel status information 150.

The LED data/timing controller 122 includes an input to receive LED display data 168 representing operational control information for the LED panel 102 (e.g., indicating which LED strings to activate at any given time point, what duration they are to be activated for, and at what current level) and outputs to provide control signals 175, 176, and 177 to the current regulators 125, 126, and 127, respectively. During the normal operational mode, the LED data/timing controller 122 uses the control signals 175-177 to selectively activate or "turn on" the enabled current regulators based on the LED display data 168. To illustrate, because the LED channels 115 and 117 are connected to the tail ends of operational LED strings while the LED channel 116 is not connected to an operational LED string in the example of FIG. 1, the detect controller 138 would enable the current regulators 125 and 127 and disable the current regulator 126 during the operational mode. Thus, during the operational mode the LED data/timing controller 122 could selectively activate the current regulators 125 and 127 so as to selectively activate the LED strings 105 and 107 responsive to the LED display data 168. However, because the current regulator 126 is disabled during the operational mode, the LED data/timing controller 122 is prevented from activating the current regulator 126 based on the LED display data 168.

The voltage controller 124 includes inputs to receive the voltage control signal 149, the LED channel status information 150, the voltages $V_{T1}$, $V_{T2}$, $V_{T3}$, and $V_{FB}$, and an output to provide a voltage control signal 180 to the voltage source 112. During start-up, the voltage controller 124 controls the voltage source 112 to ramp-up the magnitude of the voltage $V_{OUT}$ based on the voltage control signal 149 from the detect controller 138. During normal operation mode, the voltage controller 124 uses one or more of the voltages $V_{T1}$, $V_{T2}$, $V_{T3}$, or $V_{FB}$ to control the magnitude of the voltage $V_{OUT}$ output by the voltage source 112. To illustrate, in one embodiment the voltage controller 124 uses only the voltage $V_{FB}$ to maintain the voltage $V_{OUT}$ at a constant level during the normal operational mode. In another embodiment, the voltage controller 124 uses a selected tail voltage of one of the LED strings (e.g., one of the tail voltages $V_{T1}$, $V_{T2}$, or $V_{T3}$) to control the voltage source 112 to maintain the selected tail voltage at or near a predetermined level (e.g., 0.5 V). In another embodiment, the voltage controller 124 uses a technique based on the minimum of the tail voltages to control the voltage source 112 as disclosed in U.S. patent application Ser. No. 12/056,237, entitled "LED Driver with Dynamic Power Management" and filed on Mar. 26, 2008, the entirety of which is incorporated by reference herein. Further, because such feedback techniques assume an active LED channel, the voltage controller 124 is configured such that the tail voltages or LED channel input voltages of LED channels that are turned off (as indicated by the LED channel status information 150) are not used for controlling the voltage source 112 during the normal operation mode. To illustrate, because in the example of FIG. 1 it is discerned that the LED channel 116 is not connected to an operational LED string, the voltage controller 124 would not utilize the voltage $V_{T2}$ for purposes of controlling the magnitude of the voltage $V_{OUT}$.

Figure 2:
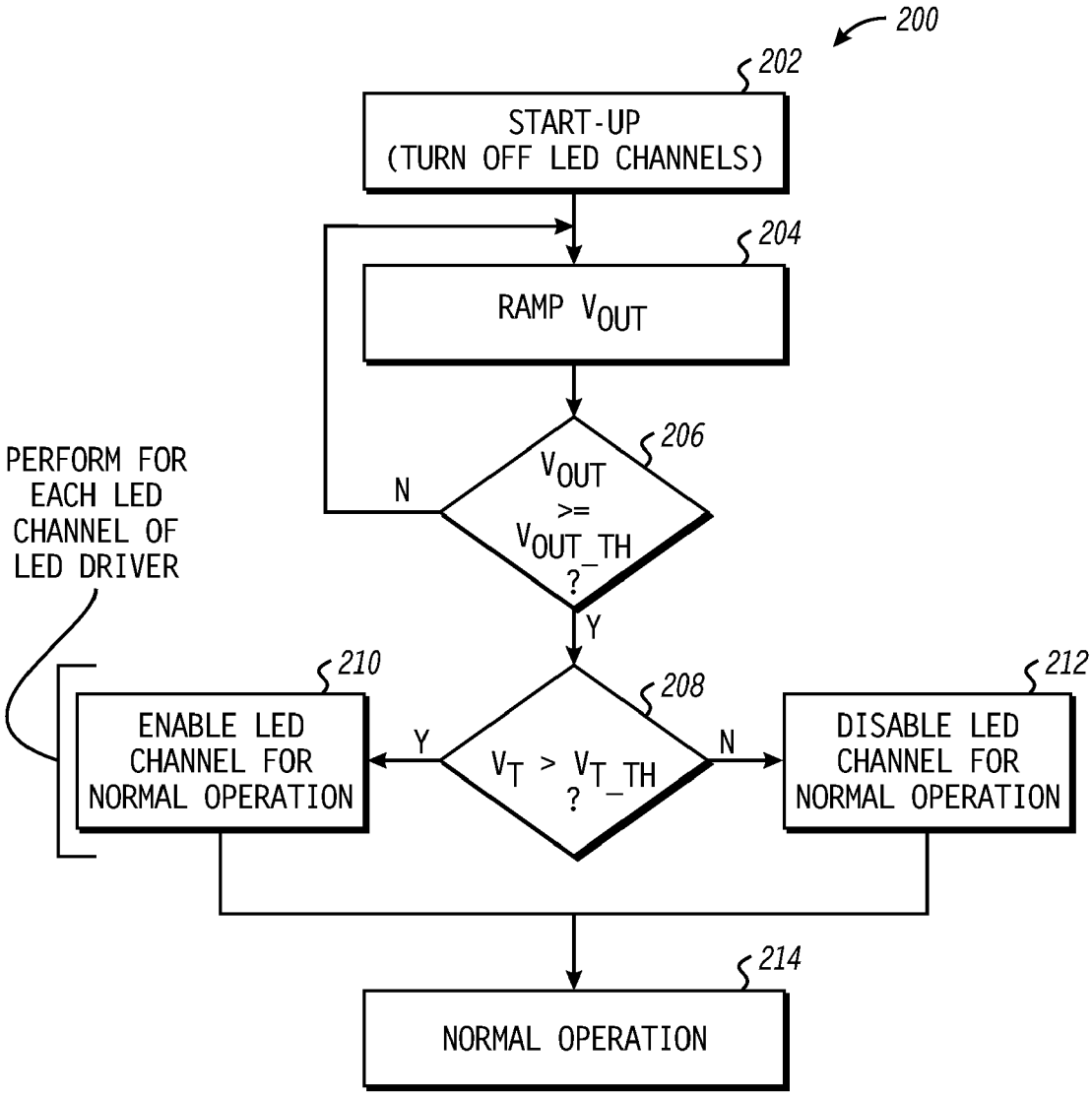
FIG. 2 is a flow diagram illustrating a method of operation of the LED system of FIG. 1 in accordance with at least one embodiment of the present disclosure.

FIG. 2 illustrates an example method 200 of operation of the LED system 100 of FIG. 1 in accordance with at least one embodiment of the present disclosure. At block 202, a reset or power-on event occurs in the LED system 100, thereby causing the LED driver 104 to enter a start-up mode. In response to entering the start-up mode, the detect controller 138 disables the LED channels 115-117 by, for example, configuring the current regulators 125-127 into a high-impedance state (i.e., disabling the current regulators 125-127). At blocks 204 and 206 the LED driver 104 controls its voltage source (e.g., the voltage source 112) to ramp up the output voltage $V_{OUT}$ until it meets the predetermined threshold voltage $V_{OUT_TH}$ that is equal to the over-voltage protection threshold $V_{OVP}$ or less than $V_{OVP}$ by a certain offset C. As described above, this condition can be determined based on the comparison between the feedback voltage $V_{FB}$ (derived from the voltage $V_{OUT}$) and the threshold voltage $V_{FB_TH}$ performed by the comparator 140 of FIG. 1.

Once the voltage $V_{OUT}$ is at the threshold voltage $V_{OUT_TH}$, the voltage $V_{OUT}$ is maintained at the threshold voltage $V_{OUT_TH}$ for the remainder of the start-up mode. At block 208 each of the comparators 141-143 compares the threshold voltage $V_{T_TH}$ with its respective one of the LED channel input voltages $V_{T1}$, $V_{T2}$, and $V_{T3}$ and the detect controller 138 uses the relationships between the LED channel input voltages and the threshold voltage $V_{T_TH}$ (as represented by the states of the signals 145-147 output by the comparators 141-143, respectively) to determine which LED channels are connected to an operational LED string and which LED channels are not connected to an operational LED string. In the event that the voltage at the LED channel input of an LED channel is greater than the threshold voltage $V_{T_TH}$, at block 210 the detect controller 138 determines that the LED channel is connected to the tail end of an operational LED string and therefore enables the LED channel for the normal operational mode that follows the start-up mode. In the event that the voltage at the LED channel input is less than the threshold voltage $V_{T_TH}$, at block 212 the detect controller 138 determines that the LED channel is not connected to an operational LED string and therefore disables the LED channel for the following normal operational mode. In one embodiment, the detect controller 138 can enable the LED channel by configuring the corresponding current regulator to permit flow of current at the LED channel input and the detect controller 138 can disable the LED channel by configuring the corresponding current regulator to inhibit flow of current at the LED channel input.

After all LED channels have been checked and their connection status determined, the LED driver 104 enters the normal operational mode at block 214. During the normal operational mode, the LED data/timing controller 122 selectively actives the enabled current regulators of the enabled LED channels based on the received LED display data 168 to as to control activation of the LED strings of the LED panel 102 in accordance with the control information represented by the LED display data 168.

Figure 3:
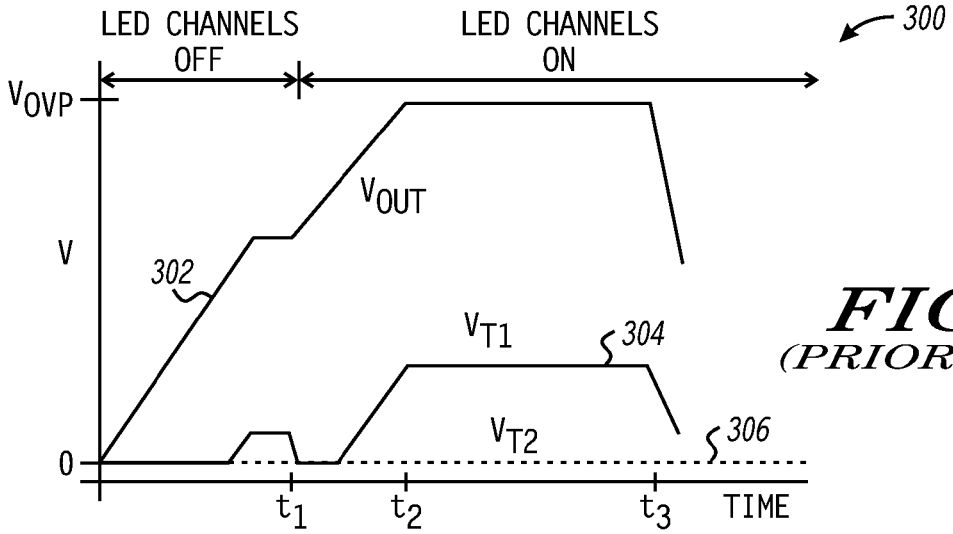
FIG. 3 (PRIOR ART)
FIG. 3 is a graph diagram illustrating an operation of a conventional LED system.
Figure 4:
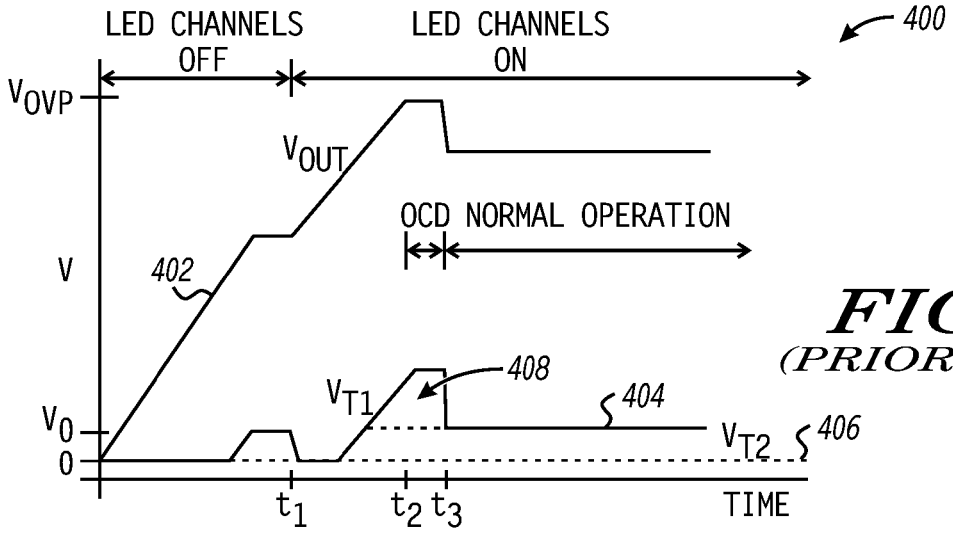
FIG. 4 (PRIOR ART)
FIG. 4 is a graph diagram illustrating an operation of another conventional LED system.
Figure 5:
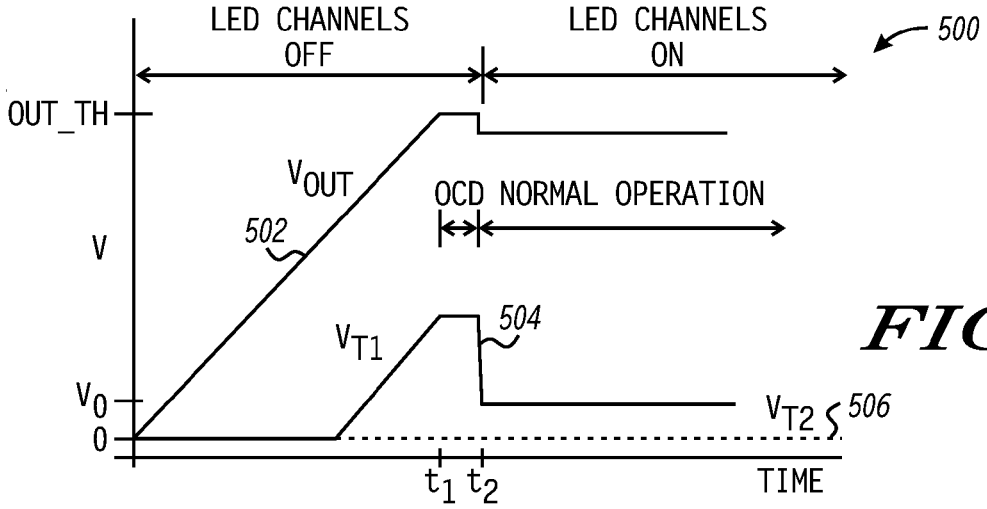
FIG. 5 is a graph diagram illustrating an example operation of the LED system of FIG. 1 in accordance with at least one embodiment of the present disclosure.

FIGS. 3-5 illustrate a comparison of conventional techniques to the open channel detection technique described above in accordance with at least one embodiment of the present disclosure. FIG. 3 is a graph 300 illustrating an operation of a conventional LED driver that does not implement any form open channel detection. Line 302 represents the output voltage of the conventional LED driver used to drive the LED strings of a LED panel, line 304 represents the voltage ($V_{T1}$) at a first LED channel input that is connected to an operational LED string, and line 306 illustrates a voltage ($V_{T2}$) at a second LED channel input that is not connected to an operational LED string. In the depicted operation, the conventional LED driver ramps up the output voltage $V_{OUT}$. At some point after the power-up softstart ends, the LED channels are enabled at time $t_1$ and the LED panel 102 is enabled, thereby permitting current flow at the LED channel inputs. Many conventional LED drivers are configured to continue increasing the output voltage until all LED channel inputs are at or above a tail end threshold (e.g., 0.5 V). However, because the second LED channel is not connected to an operational LED string, the voltage $V_{T2}$ stays at nearly zero volts. Thus, in an attempt to increase the voltage $V_{T2}$ at the non-connected second LED channel to above this tail end threshold, the conventional LED driver continues to ramp up the output voltage until it reaches the over-voltage protection threshold $V_{OVP}$ at time $t_2$. Because the first LED channel is connected to the tail end of an operational LED string, the voltage $V_{T1}$ begins to increase as the output voltage $V_{OUT}$ ramps up. The output voltage is maintained at the $V_{OVP}$ until an over-voltage timer times out or thermal shutdown is triggered at time $t_3$ and the conventional LED driver shuts down to prevent damage to the device. Thus, for such conventional LED drivers, the failure to connect each and every LED channel to an operational LED string can result in failed operation or shutdown of the LED driver.

FIG. 4 is a graph 400 illustrating an operation of a conventional LED driver that implements a conventional open channel detection process. Line 402 represents the output voltage of the conventional LED driver used to drive the LED strings of a LED panel, line 404 represents the voltage ($V_{T1}$) at a first LED channel input that is connected to an operational LED string, and line 406 illustrates a voltage ($V_{T2}$) at a second LED channel input that is not connected to an operational LED string and at nearly zero volts. In the depicted operation, the conventional LED driver ramps up the output voltage $V_{OUT}$. At time $t_1$ the LED channels are enabled, thereby permitting substantial current flow at the LED channel inputs. Again, in an attempt to increase the voltage $V_{T2}$ at the non-connected second LED channel to above the tail end threshold, the conventional LED driver continues to ramp up the output voltage. At time $t_2$ the output voltage $V_{OUT}$ reaches the over-voltage protection threshold $V_{OVP}$ and a conventional open channel detection process is performed until time $t_3$, at which point a normal operation modes is entered and the output voltage $V_{OUT}$ is brought down to an operational level such that the tail voltage $V_{T1}$ of the LED string of the first LED channel is brought down to its operational tail voltage $V_0$. However, because the LED channels are enabled during the open channel detection process (thereby permitting current flow through the first LED string) and because the first LED string is driven by a voltage $V_{OUT}$ higher than necessary, excess power is consumed until the voltage $V_{OUT}$ is brought down to the normal operational level (and thus bringing down the tail voltage of the first LED string). The region 408 of graph 400 represents this excess power consumption, which can result in thermal shutdown or damage to the device as the excess power typically is dissipated as heat. Further, for mobile display devices relying on battery power, such excess power consumption can significantly reduce the operating lifetime.

FIG. 5 is a graph 500 illustrating an example operation of the LED driver 104 of the LED system 100 of FIG. 1. Line 502 represents the output voltage $V_{OUT}$ of the LED driver 104 used to drive the LED panel 102, line 504 represents the voltage ($V_{T1}$) at a first LED channel input (e.g., LED channel input 131, FIG. 2) that is connected to an operational LED string (e.g., LED string 105), and line 506 illustrates a voltage ($V_{T2}$) at a second LED channel input (e.g., LED channel input 132, FIG. 1) that is not connected to an operational LED string. In the depicted process, at start up the LED driver 104 disables the LED channels and ramps up the output voltage $V_{OUT}$ to a predetermined voltage $V_{OUT_TH}$, which is equal to or less than the over-voltage protection threshold $V_{OVP}$ of the LED driver 104. However, because the LED driver 104 utilizes an open channel detection process that does not allow substantial current flow through the LED strings, there is almost no power dissipation and heat generation in this process and thus avoiding thermal issues. To illustrate, the output voltage $V_{OUT}$ can be ramped up to a voltage $V_{OUT_TH}$ that is a few volts or other offset less than the over-voltage protection threshold $V_{OVP}$. At time $t_1$, the output voltage $V_{OUT}$ reaches the voltage $V_{OUT_TH}$ and the open channel detection process is conducted while the LED channels are disabled as described above. Once the open channel detection process is completed, at time $t_2$ the LED driver 104 enters an operational mode whereby the output voltage $V_{OUT}$ is lowered to an operational level and the LED channels connected to an operational LED string are turned on and off based on the LED display data during the operational mode.

Because all of the LED channels are turned off during the open channel detection process and the disconnected channels are subsequently excluded from use in determining the magnitude of the output voltage $V_{OUT}$ during normal operation, the LED driver 104 can avoid an over-voltage protection (OVP) or over-temperature protection (OTP) condition, and thus avoid thermal issues. Accordingly, not only can excess power consumption be avoided, an output voltage lower than the over-voltage protection threshold can be used during the open channel detection process, thereby reducing or eliminating thermal issues during the start-up mode of the LED driver 104. Thus, a single LED driver configuration can be used with LED panels with different number of LED strings, thereby facilitating implementation in any of a variety of applications.

The terms "including", "having", or any variation thereof, as used herein, are defined as comprising. The term "coupled", as used herein with reference to electro-optical technology, is defined as connected, although not necessarily directly, and not necessarily mechanically. The term "equal," as used herein with respect to two values (e.g., voltages), refers to a relationship of equality between the two values in view of the characteristics and limitations of the circuitry determining the relationship between the two values. To illustrate, if a comparator has the electrical and physical characteristics such that it identifies two voltages as equal when they are within, for example, 5% of each other, then two voltages within 5% of each other are considered equal as measured or determined by the comparator.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

What is claimed is:

1. A method comprising:

providing a light emitting diode (LED) driver comprising a voltage source having an output configured to couple to a head end of each of one or more LED strings of a LED panel and a plurality of LED channels, each LED channel comprising an LED channel input configured to couple to a tail end of a corresponding LED string; and for a first mode of the LED driver:

configuring each LED channel to inhibit current flow through the LED channel during the first mode;

configuring the voltage source to provide a predetermined first voltage at the output; and determining, for each LED channel, whether the LED channel is coupled to a non-operational LED string based on a voltage at the LED channel input of the LED channel.

2. The method of claim 1, wherein each LED channel includes a corresponding current regulator coupled to the corresponding LED channel input, and wherein configuring each LED channel to inhibit current flow comprises disabling the corresponding current regulator.

3. The method of claim 1, wherein configuring the voltage source to provide an output voltage having the predetermined first voltage comprises increasing a voltage at the output until the voltage at the output is equal to the predetermined first voltage.

4. The method of claim 1, wherein determining whether the LED channel input is coupled to a non-operational LED string comprises:

determining the LED channel input is coupled to an operative LED string in response to determining the voltage at the LED channel input is greater than a predetermined second voltage; and determining the LED channel input is not coupled to an operative LED string in response to determining the voltage at the LED channel input is not greater than the predetermined second voltage.

5. The method of claim 1, wherein the predetermined first voltage is less than an over-voltage protection threshold of the LED driver.

6. The method of claim 1, further comprising:

for a second mode of the LED driver subsequent to the first mode:

configuring the voltage source to provide a second voltage at the output;

for each LED channel determined as not connected to an operational LED string, configuring the LED channel to inhibit current flow through the LED channel; and for each LED channel determined as connected to an operational LED string, configuring the LED channel to permit current flow through the LED channel responsive to display data associated with the LED panel.

7. The method of claim 6, further comprising:

for the second mode, controlling the voltage source to adjust an output voltage using tail voltages of LED channels determined as connected to an operational LED string and without using tail voltages of LED channels determined as not connected to an operational LED string.

8. The method of claim 1, wherein providing the LED driver comprises providing an integrated circuit (IC) device comprising the LED driver, and wherein the IC device comprises a plurality of input pins, each input pin coupled to a corresponding LED channel input and configured to couple to a tail end of a corresponding LED string.

9. A system comprising:

a light emitting diode (LED) driver comprising:

a voltage source having an output configured to couple to a head end of each of one or more LED strings of a LED panel; and a plurality of LED channels, each LED channel comprising an LED channel input configured to couple to a tail end of a corresponding LED string;

a LED channel detector configured to:

for a first mode of the LED driver:

configure each LED channel to inhibit current flow through the corresponding LED channel input during the first mode;

configure the voltage source to provide a predetermined first voltage at the output; and determine, for each LED channel input, whether the LED channel is coupled to a non-operational LED string based on a voltage at the LED channel input.

10. The system of claim 9, wherein:

each LED channel comprises a current regulator coupled to the corresponding LED channel input; and the LED channel detector is configured to configure each LED channel to inhibit current flow through the corresponding LED channel input by disabling the corresponding current regulator.

11. The system of claim 9, wherein the LED channel detector is configured to configure the voltage source to provide an output voltage having the predetermined first voltage by configuring the voltage source to increase a voltage at the output until the voltage at the output is equal to the predetermined first voltage.

12. The system of claim 9, wherein the LED channel detector is configured to determine whether the LED channel input is coupled to a non-operational LED string by:

determining the LED channel input is coupled to an operative LED string in response to determining the voltage at the LED channel input is greater than a predetermined second voltage; and determining the LED channel input is not coupled to an operative LED string in response to determining the voltage at the LED channel input is not greater than the predetermined second voltage.

13. The system of claim 12, wherein the LED channel detector comprises:

a comparator having a first input to receive the predetermined second voltage, a second input coupled to the LED channel input of an LED channel, and an output; and a detect controller comprising an input coupled to the output of the comparator, the detect controller configured to selectively enable or disable the LED channel based on a state of the output of the comparator.

14. The system of claim 9, wherein the predetermined first voltage is less than an over-voltage protection threshold of the LED driver.

15. The system of claim 9, further comprising:

a LED data/timing controller configured to:

for a second mode of the LED driver subsequent to the first mode:

configure the voltage source to provide a second voltage at the output; and for each LED channel input determined to be connected to an operational LED string, selectively configure the LED channel to permit current flow through the corresponding LED channel input responsive to display data associated with the LED panel; and wherein the LED channel detector is configured to:

for the second mode:

for each LED channel input determined as connected to a non-operational LED string, configure the LED channel to inhibit current flow through the corresponding LED channel input.

16. The system of claim 15, wherein the LED driver is configured to:

for the second mode, control the voltage source to adjust an output voltage using tail voltages of LED channels determined as connected to an operational LED string and without using tail voltages of LED channels determined as not connected to an operational LED string.

17. The system of claim 9, the LED driver is an integrated circuit (IC) device comprising a plurality of input pins, each input pin coupled to a corresponding LED channel input and configured to couple to a tail end of a corresponding LED string.

18. A system comprising:

a light emitting diode (LED) panel; and a LED driver comprising an output coupled to the LED panel, a first LED channel coupled to a tail end of a first LED string, and a second LED channel coupled to a tail end of a second LED string, the LED driver configured to:

determine the first LED string is operational based on a first voltage at the first LED channel input while the first LED channel is configured to inhibit current flow during a start-up mode; and determine the second LED string is not operational based on a second voltage at an input of the second LED channel while the second LED channel is configured to inhibit current flow during the start-up mode.

19. The system of claim 18, wherein the LED driver further is configured to:

inhibit flow of current at the second LED channel input during an operational mode responsive to determining the second LED string is not operative; and permit flow of current at the first LED channel input during the operational mode responsive to determining the first LED string is operative.

20. The system of claim 18, wherein the LED driver further is configured to provide a predetermined voltage at the output coupled to the LED panel during the start-up mode, the predetermined voltage being less than an over-voltage protection threshold of the LED driver.

* * * * *